US011814736B2

(12) United States Patent
Tsuji et al.

(10) Patent No.: US 11,814,736 B2
(45) Date of Patent: Nov. 14, 2023

(54) PICKLING FACILITY AND OPERATION METHOD OF PICKLING FACILITY

(71) Applicant: PRIMETALS TECHNOLOGIES JAPAN, LTD., Hiroshima (JP)

(72) Inventors: Kosei Tsuji, Hiroshima (JP); Ryusuke Nakatsuka, Hiroshima (JP); Masashi Yoshikawa, Tokyo (JP); Shinji Nanba, Tokyo (JP)

(73) Assignee: PRIMETALS TECHNOLOGIES JAPAN, LTD., Hiroshima (JP)

( * ) Notice: Subject to any disclaimer, the term of this patent is extended or adjusted under 35 U.S.C. 154(b) by 483 days.

(21) Appl. No.: 16/982,905

(22) PCT Filed: Apr. 16, 2018

(86) PCT No.: PCT/JP2018/015751

§ 371 (c)(1),
(2) Date: Sep. 21, 2020

(87) PCT Pub. No.: WO2019/202644

PCT Pub. Date: Oct. 24, 2019

(65) Prior Publication Data

US 2021/0002774 A1 Jan. 7, 2021

(51) Int. Cl.
*C23G 1/02* (2006.01)
*C23G 3/02* (2006.01)
(Continued)

(52) U.S. Cl.
CPC ..... *C23G 3/021* (2013.01); *B08B 3/041* (2013.01); *B08B 3/08* (2013.01); *C23G 1/086* (2013.01);
(Continued)

(58) Field of Classification Search
None
See application file for complete search history.

(56) References Cited

U.S. PATENT DOCUMENTS 4,963,205 A * 10/1990 Hubert ..... B08B 7/0092 156/80
5,248,372 A * 9/1993 McNamee ..... C23G 3/021 204/194
2021/0002774 A1* 1/2021 Tsuji ..... C23G 3/026

FOREIGN PATENT DOCUMENTS

CN 202433748 U 9/2012
CN 104762633 A 7/2015
(Continued)

OTHER PUBLICATIONS

Office Action dated Aug. 10, 2021 issued in counterpart Japanese Application No. 2020-514812 with an English Machine Translation.
(Continued)

*Primary Examiner* — Eric W Golightly
*Assistant Examiner* — Ryan L Coleman
(74) *Attorney, Agent, or Firm* — Birch, Stewart, Kolasch & Birch, LLP

(57) ABSTRACT

A pickling facility includes: a pickling tank for storing an acid solution; a conveyance part for continuously conveying a steel plate immersed in the acid solution; a measurement part for measuring at least one parameter which has a correlation with a heat transfer coefficient between the acid solution and a reference surface disposed in the acid solution so as to face the steel plate; and a conveyance speed decision part configured to decide a conveyance speed of the steel plate conveyed by the conveyance part, on the basis of a measurement result of the at least one parameter.

13 Claims, 6 Drawing Sheets

(51) Int. Cl.

| | |
|---|---|
| ***B08B 3/04*** | (2006.01) |
| ***B08B 3/08*** | (2006.01) |
| ***C23G 1/08*** | (2006.01) |

(52) U.S. Cl.
CPC ..... *C23G 3/026* (2013.01); *C23G 3/027* (2013.01); *B08B 2203/007* (2013.01)

(56) References Cited

FOREIGN PATENT DOCUMENTS

| | | | |
|---|---|---|---|
| JP | 10-306391 | A | 11/1998 |
| JP | 11-189885 | A | 7/1999 |
| JP | 2003-231981 | A | 8/2003 |
| JP | 2003-342764 | A | 12/2003 |
| JP | 2004-52030 | A | 2/2004 |
| JP | 2005-200697 | A | 7/2005 |

OTHER PUBLICATIONS

International Search Report for PCT/JP2018/015751 dated Jul. 3, 2018.
International Preliminary Report on Patentability and Written Opinion of the International Searching Authority for International Application No. PCT/JP2018/015751, dated Oct. 29, 2020, with an English translation.
Indian Office Action for Indian Application No. 202017039677, dated Apr. 27, 2021, with English translation.

* cited by examiner

PICKLING FACILITY AND OPERATION METHOD OF PICKLING FACILITY

TECHNICAL FIELD

The present disclosure relates to a pickling facility and an operation method of a pickling facility.

BACKGROUND ART

The procedure of producing a steel plate involves formation of scale (oxide layer) on the surface of the steel plate during the hot rolling step or the cooling step, for instance. A pickling process may be performed in order to remove scale formed on the steel plate surface.

As an example of a device that performs the pickling process of a steel plate, Patent Document 1 discloses a continuous pickling facility including a plurality of pickling tanks arranged in series, the pickling tanks storing an acid solution for the pickling process of the steel plate. In the continuous pickling facility, a rolled steel plate is conveyed through the acid solution of the plurality of pickling tanks successively, and thereby the scale formed on the steel plate surface is dissolved and removed by the acid solution.

CITATION LIST

Patent Literature

Patent Document 1: JP2005-200697A

SUMMARY

Problems to be Solved

Meanwhile, to improve the production efficiency, it is desirable to increase the conveyance speed (line speed) of the steel plate in the continuous pickling process as much as possible. However, typically it is not possible to directly measure the progress of the pickling process, and thus the line speed is set lower with allowance, in order to ensure sufficient time for the pickling process. Thus, it is desirable to determine the state of the pickling process and set an appropriate line speed, so as to improve the production efficiency of the steel plate.

In view of the above, an embodiment of at least one embodiment of the present invention is to provide a pickling facility and an operation method of a pickling facility, capable of improving the production efficiency of the steel plate.

Solution to the Problems

According to at least one embodiment of the present invention, a pickling facility includes: a pickling tank for storing an acid solution; a conveyance part for continuously conveying a steel plate immersed in the acid solution; a measurement part for measuring at least one parameter which has a correlation with a heat transfer coefficient between the acid solution and a reference surface disposed in the acid solution so as to face the steel plate; and a conveyance speed decision part configured to decide a conveyance speed of the steel plate conveyed by the conveyance part, on the basis of a measurement result of the at least one parameter.

Advantageous Effects

According to at least one embodiment of the present invention, provided is a pickling facility and an operation method of a pickling facility, capable of improving the production efficiency of the steel plate.

DETAILED DESCRIPTION

Embodiments of the present invention will now be described in detail with reference to the accompanying drawings. It is intended, however, that unless particularly identified, dimensions, materials, shapes, relative positions and the like of components described in the embodiments shall be interpreted as illustrative only and not intended to limit the scope of the present invention.

Figure 1:
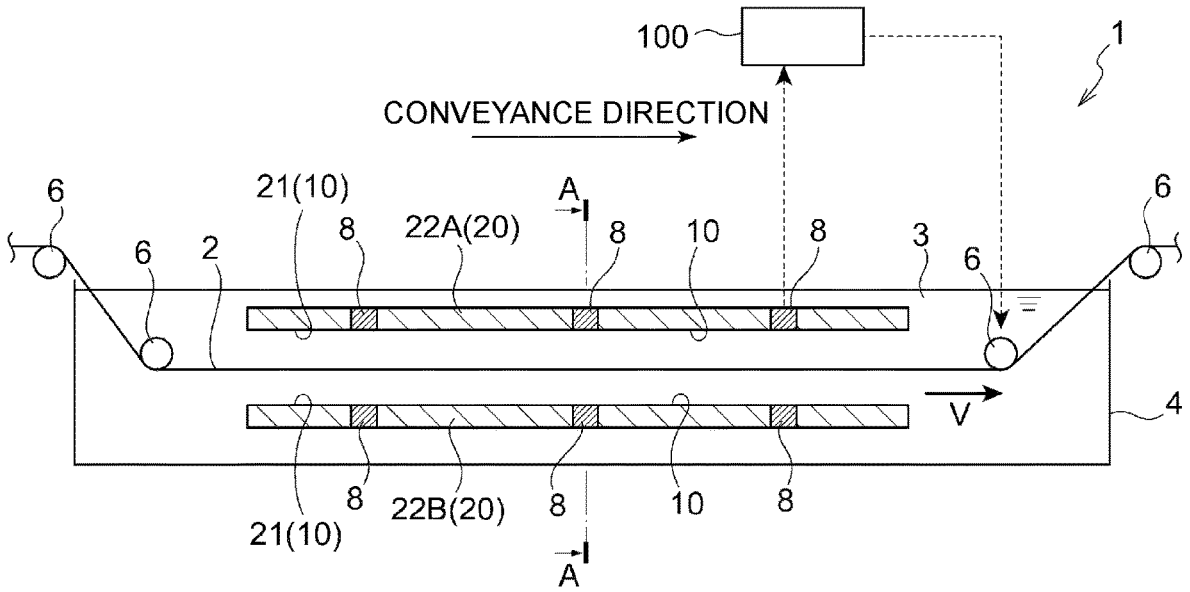
FIG. 1 is a schematic diagram of a pickling facility according to an embodiment.
Figure 2:
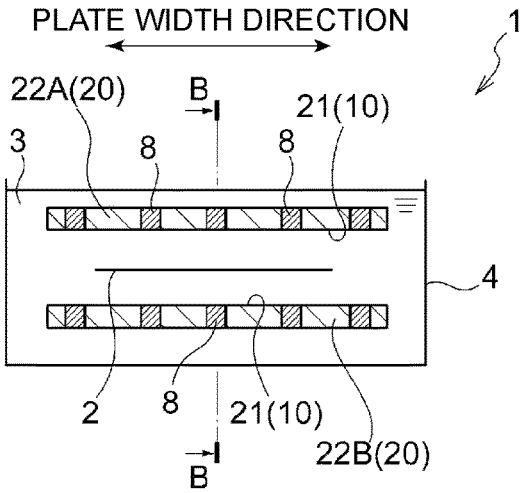
FIG. 2 is an A-A cross-sectional view of the pickling facility depicted in FIG. 1.

FIG. 1 is a schematic diagram of a pickling facility according to an embodiment. FIG. 2 is an A-A cross-sectional view of the pickling facility depicted in FIG. 1. Also, FIG. 1 is a B-B cross-sectional view of FIG. 2.

As depicted in FIGS. 1 and 2, the pickling facility 1 according to an embodiment includes a pickling tank 4 for storing an acid solution 3, and a conveyance roll (conveyance part) 6 for continuously conveying a steel plate 2 having a strip shape immersed in the acid solution 3.

The acid solution 3 is a pickling solution for dissolving and removing the scale (oxide layer) formed on the surface of the steel plate 2. For instance, the acid solution 3 is a liquid containing acid such as hydrochloric acid, sulfuric acid, nitric acid, or hydrofluoric acid.

The conveyance roll 6 is configured to apply tension to the steel plate 2 and convey the steel plate 2. The conveyance speed (line speed) V of conveyance of the steel plate 2 by the conveyance roll 6 is controlled by the control device 100 described below.

Furthermore, the pickling facility 1 includes a measurement part 8 for measuring the parameter having a correlation with the heat transfer coefficient $h_R$ between the acid solution 3 and the reference surface 10 that is disposed so as to face the steel plate 2 in the acid solution 3, and a conveyance speed decision part configured to decide the conveyance speed (line speed) V of conveyance of the steel plate 2 by the conveyance roll 6. In the embodiment depicted in FIGS. 1 and 2, the conveyance speed decision part is implemented as a function of the control device 100. That is, the control device 100 includes the above described conveyance speed decision part.

Furthermore, the part (shaded area) indicated by the reference numeral 8 in FIGS. 1 and 2 merely indicates the position where the measurement part 8 is provided, and does not represent the cross-sectional shape of the measurement part 8.

As depicted in FIGS. 1 and 2, the pickling facility 1 includes a structural body 20 having a surface 21 that faces the steel plate 2, and the above described reference surface 10 includes the surface 21 of the structural body 20.

In an illustrative embodiment depicted in FIGS. 1 and 2, the structural body 20 includes plate-shaped members 22A and 22B disposed so as to face the two surfaces of the steel plate 2 respectively, and each of the plate-shaped members 22A, 22B has the surface 21 that faces the steel plate 2.

The conveyance speed decision part is configured to decide the line speed V on the basis of the measurement result of the parameter measured by the measurement part 8.

In some embodiments, the conveyance speed decision part may be configured to calculate the heat transfer coefficient between the reference surface 10 and the acid solution 3 from the measurement result of the above described parameter obtained by the measurement part 8, and decide the line speed V on the basis of the accordingly calculated heat transfer coefficient The control device 100 may further include a conveyance control part (not depicted) that controls the conveyance roll 6 so that the steel plate 2 is conveyed at the line speed V decided by the conveyance speed decision part.

The control device 100 may include a CPU, a memory (RAM), an auxiliary storage device, and an interface, for instance.

The control device 100 is configured to receive information (signal that indicates the measurement result) from the measurement part 8 via the interface.

The CPU is configured to process the accordingly received information. Further, the CPU is configured to process the program expanded in the memory.

The conveyance speed decision part and the conveyance control part may be implemented as programs to be executed by the CPU, and stored in the auxiliary storage device.

When the programs are executed, the programs are expanded in the memory. The CPU reads out the programs from the memory, and executes the orders contained in the programs by using the information received from the measurement part 8 as needed.

Figure 10:
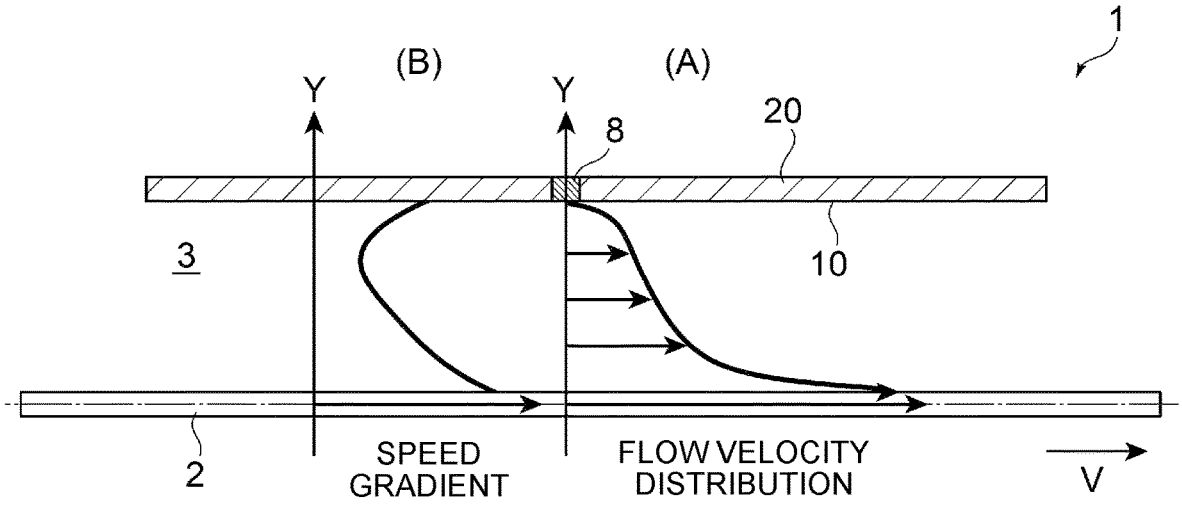
FIG. 10 is a graph showing an example of the velocity distribution and the velocity gradient of the acid solution in the pickling facility according to an embodiment.

Herein, FIG. 10 includes a graph (A) showing an example of the flow velocity distribution and a graph (B) showing an example of the speed gradient, of the acid solution 3 in the direction orthogonal to the conveyance direction (Y direction in FIG. 10) during conveyance of the steel plate 2 in the acid solution 3 in the pickling facility 1.

According to the findings of the present inventors, the heat transfer coefficient $h_R$ between the acid solution 3 and the reference surface 10 disposed so as to face the steel plate 2 being conveyed through the acid solution 3 has a correlation with the heat transfer coefficient $h_0$ between the steel plate and the acid solution.

That is, the flow of the acid solution 3 caused by conveyance of the steel plate 2 also affects the flow velocity distribution of the acid solution 3 in the vicinity of the reference surface 10 facing the steel plate 2 in accordance with the conveyance speed (line speed) V of the steel plate 2.

For instance, when the steel plate 2 is conveyed through the acid solution 3, the flow velocity distribution of the acid solution 3 becomes smaller toward the reference surface 10 from the steel plate 2 in the direction (Y direction in FIG. 10) orthogonal to the conveyance direction (see the graph (A) in FIG. 10).

Furthermore, when the conveyance speed (line speed) V of the steel plate 2 is changed, the flow velocity of the acid solution 3 changes at the same ratio in the entire range from the surface of the steel plate 2 to the reference surface 10 in the Y direction, and the speed gradient of the acid solution 3 also changes in accordance with the change of the flow velocity of the acid solution 3.

That is, when the flow velocity of the acid solution 3 increases at the surface of the steel plate 2, the flow velocity of the acid solution 3 at the reference surface 10 also changes at the same ratio, while the speed gradient of the acid solution 3 at the surface of the steel plate 2 and the reference surface 10 also changes in accordance with the change of the flow velocity.

Herein, the mass transfer coefficient and the heat transfer coefficient between the wall surface (surface of the steel plate 2 or the reference surface 10) and the acid solution 3 increases with the speed gradient at the wall surface.

That is, when the conveyance speed of the steel plate 2 changes, the heat transfer coefficient $h_0$ at the surface of the steel plate 2 and the heat transfer coefficient $h_R$ at the reference surface 10 change in accordance with the change in the conveyance speed (i.e., the mass transfer coefficient changes).

Thus, by calculating the heat transfer coefficient $h_R$ at the reference surface 10, it is possible to evaluate the heat transfer coefficient $h_0$ at the surface of the steel plate 2 indirectly. That is, the heat transfer coefficient $h_R$ between the reference surface 10 and the acid solution 3 can be used as an index of the heat transfer coefficient $h_0$ at the surface of the steel plate 2, and thus can be used as an index of the pickling speed of the steel plate 2.

In this regard, in the above described embodiment, at least one parameter having a correlation with the heat transfer coefficient $h_R$ between the acid solution 3 and the reference surface 10 disposed so as to face the steel plate 2 in the acid solution 3 is measured. Thus, it is possible to determine the pickling speed of the steel plate 2 or the progress state of the pickling process from the at least one parameter. Thus, it is possible to appropriately set the conveyance speed (line speed) V of the steel plate 2 taking into account the at least one parameter, and thereby it is possible to improve the production efficiency of the steel plate 2.

Furthermore, in a case where the heat transfer coefficient $h_R$ between the reference surface 10 and the acid solution 3 is calculated from the parameter measured by the measurement part 8, it is possible to appropriately set the conveyance speed (line speed) V of the steel plate 2 on the basis of the heat transfer coefficient $h_R$, and thereby it is possible to improve the production efficiency of the steel plate 2.

Once the heat transfer coefficient $h_R$ between the reference surface 10 and the acid solution 3 is obtained, it is possible to decide the conveyance speed (line speed) V of the steel plate 2 as follows, for instance.

That is, the removal of the oxidized scale on the surface of the steel plate 2 (completion of pickling) is evaluated according to the heat transfer coefficient $h_R$ that has a correlation with the heat transfer coefficient $h_0$ at the surface of the steel plate 2, and to the pickling time (proportional to the reciprocal of the line speed V).

Figure 11:
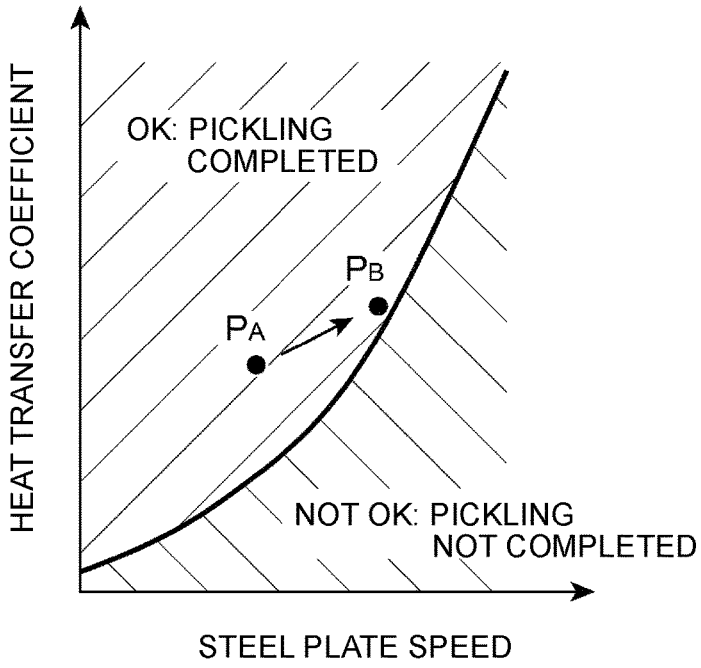
FIG. 11 is a graph showing an example of a correlation between the heat transfer coefficient and the line speed.

Thus, by actually measuring the heat transfer coefficient $h_R$ and the line speed V in the pickling facility 1, the correlation between the heat transfer coefficient $h_R$ and the line speed V is stored as a database in the memory of the control device 100. FIG. 11 is a graph showing an example of a correlation between the heat transfer coefficient $h_R$ and the line speed V (steel plate speed) obtained as described above.

Furthermore, the heat transfer coefficient $h_R$ may be measured during operation of the pickling facility 1 to determine whether it is possible to increase the conveyance speed (line speed V) of the steel plate 2 and still complete pickling on the basis of the above described database, and adjust the conveyance speed V of the steel plate 2 (i.e., the line speed V may be shifted from the point $P_A$ to the point $P_B$ in FIG. 11).

The conveyance control part may be configured to adjust (change) the tension to be applied to the steel plate 2 via the conveyance roll 6, such that the steel plate 2 is conveyed at the line speed V decided by the conveyance speed decision part. That is, the conveyance speed of the steel plate 2 may be automatically changed by the control device 100.

Alternatively, the conveyance speed of the steel plate 2 may be changed manually. That is, after the conveyance speed decision part decides the conveyance speed of the steel plate 2, the tension to be applied to the steel plate 2 via the conveyance roll 6 may be adjusted (changed) manually, such that the steel plate 2 is conveyed at the line speed V decided by the conveyance speed decision part.

As depicted in FIG. 1, the measurement part 8 may be provided at two or more different positions in the conveyance direction of the steel plate 2, and configured to measure the above described parameter at the respective positions. Furthermore, as depicted in FIG. 2, the measurement part 8 may be provided at two or more different positions in the plate width direction of the steel plate 2, and configured to measure the above described parameter at the respective positions.

Furthermore, the conveyance speed decision part may be configured to decide the conveyance speed (line speed) V of the steel plate 2 by the conveyance roll 6, on the basis of the measurement result of the above described parameter at each of the two or more positions.

In the illustrative embodiment depicted in FIGS. 1 and 2, five measurement parts 8 are disposed in the plate width direction, and three measurement parts 8 are disposed in the conveyance direction of the steel plate 2.

As described above, by measuring at least one parameter having a correlation with the heat transfer coefficient $h_R$ between the acid solution 3 and the reference surface 10 at each of a plurality of positions in the conveyance direction or the plate width direction of the steel plate 2, it is possible to determine the pickling speed of the steel plate 2 or the progress state of the pickling process more specifically. Thus, it is possible to appropriately set the conveyance speed (line speed) V of the steel plate 2 taking into account the parameter, and thereby it is possible to improve the production efficiency of the steel plate 2.

Hereinafter, the pickling facility 1 according to some embodiments will be described in more detail.

Figure 3:
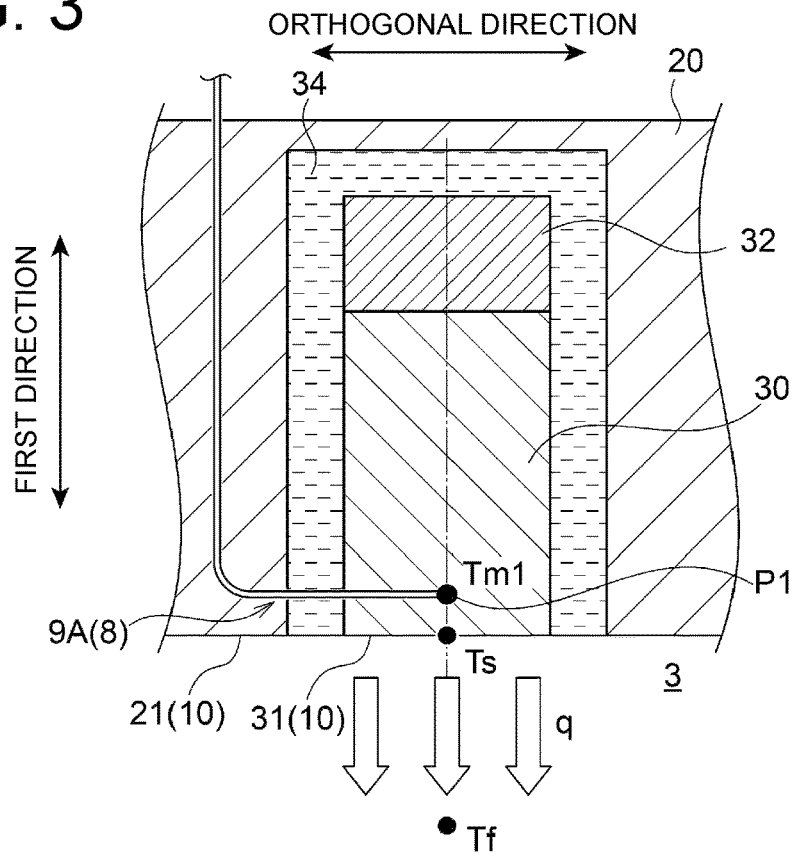
FIG. 3 is a partial schematic diagram including a measurement part of the pickling facility according to an embodiment.
Figure 4:
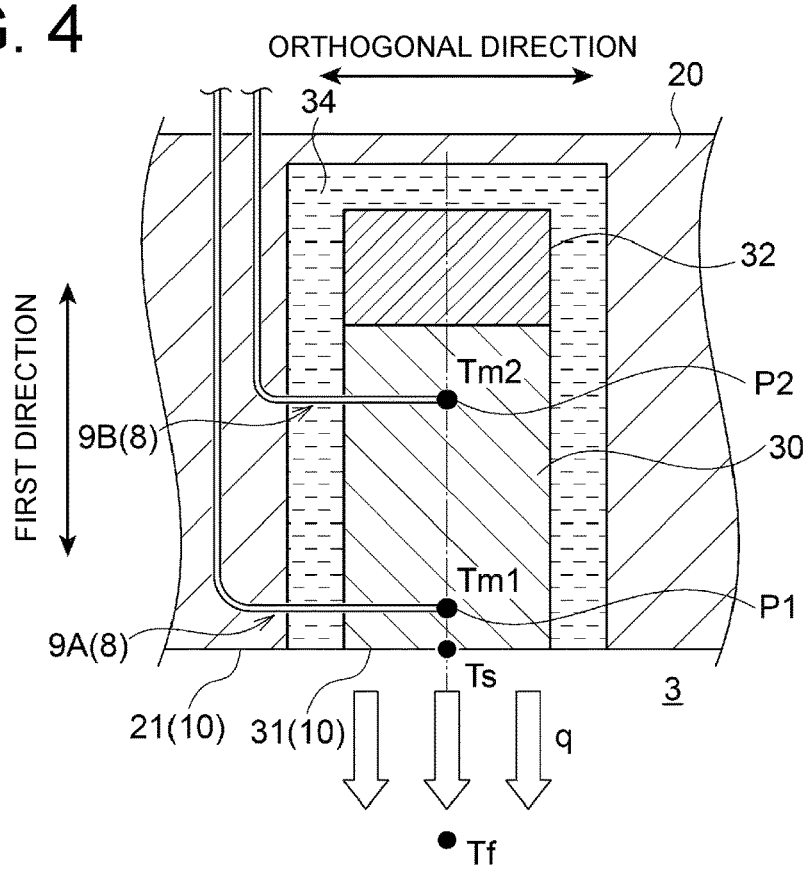
FIG. 4 is a partial schematic diagram including a measurement part of the pickling facility according to an embodiment.
Figure 5:
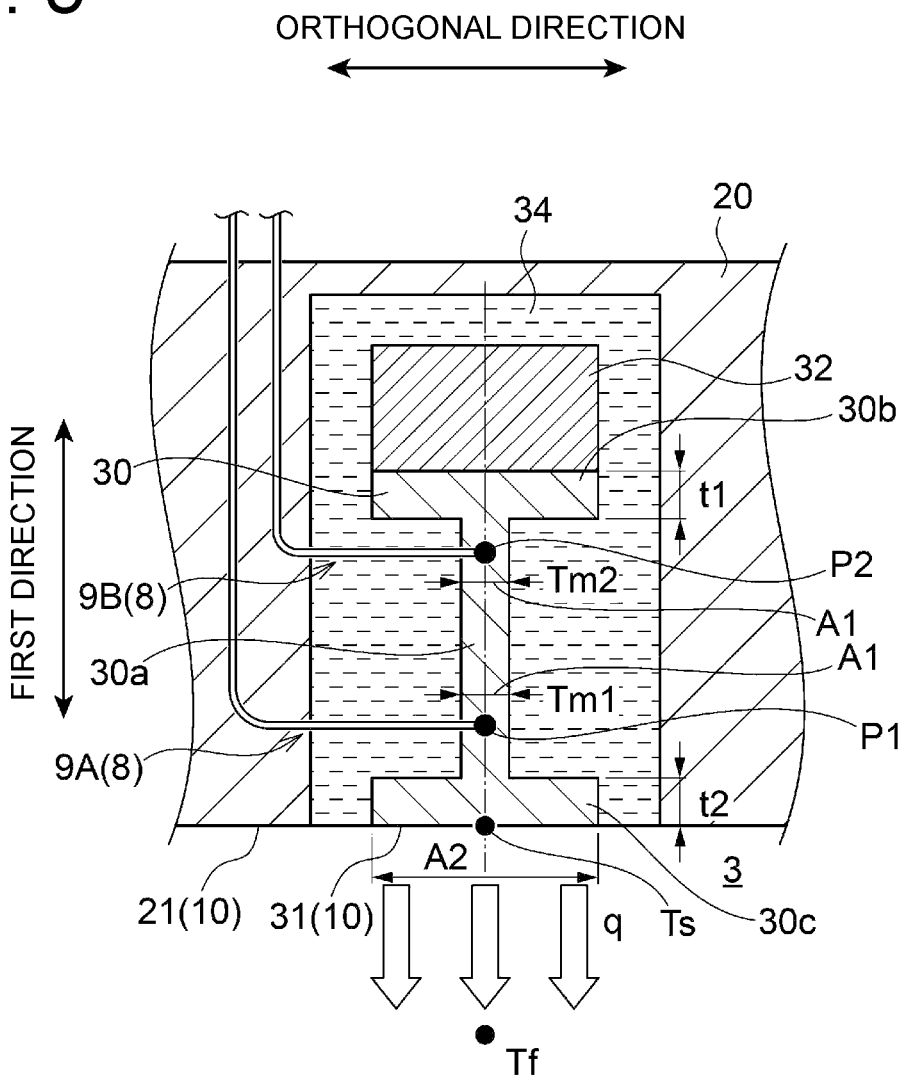
FIG. 5 is a partial schematic diagram including a measurement part of the pickling facility according to an embodiment.

FIGS. 3 to 5 are each a partial schematic diagram including the measurement part 8 of the pickling facility 1 according to an embodiment.

As depicted in FIGS. 3 to 5, the pickling facility 1 according to some embodiments includes a heat conductor 30, a heat source 32, and a heat insulator 34 that surrounds the heat conductor 30 and the heat source 32.

The heat conductor 30 has an exposed surface 31 that forms a part of the reference surface 10. Furthermore, the heat conductor 30 is supported by the structural body 20 such that the exposed surface 31 being the reference surface 10 of the heat conductor 30 faces the steel plate 2 while being exposed to the acid solution 3. The exposed surface 31 of the heat conductor 30 forms the reference surface 10 that faces the steel plate 2, along with the surface 21 of the structural body 20.

Furthermore, the reference surface 10 (exposed surface 31) of the heat conductor 30 and the reference surface 10 (surface 21) of the structural body 20 are flush with one another.

The heat source 32 is disposed to be in contact with the heat conductor 30 at the opposite side to the reference surface 10 (exposed surface 31) of the heat conductor 30, and is configured to apply heat to the heat conductor 30 and create a temperature difference between the acid solution 3 and the reference surface 10 (exposed surface 31) of the heat conductor 30. The heat source 32 may be a heater capable of heating the heat conductor 30, or a cooler capable of cooling the heat conductor 30.

In the pickling facility 1 having the above configuration, the measurement part 8 is configured to measure the temperature inside the heat conductor 30 as a parameter that has a correlation with the heat conductor $h_R$ between the acid solution 3 and the reference surface 10.

The measurement part 8 for measuring the temperature inside the heat conductor 30 may include a thermometer such as a thermocouple.

In the respective embodiments depicted in FIGS. 3 to 5, the measurement part 8 includes a thermocouple 9A configured to measure the internal temperature Tm1 of the heat conductor 30 at the point P1 of the position closer to the heat source 32 from the reference surface 10 (exposed surface 31) in the first direction connecting the reference surface 10 (exposed surface 31) of the heat conductor 30 and the heat source 32.

Furthermore, in the respective embodiments depicted in FIGS. 4 and 5, the measurement part 8 further includes a thermocouple 9B configured to measure the internal temperature Tm2 of the heat conductor 30 at the point P2 different from the point P1, in the above described first direction.

Furthermore, the conveyance speed decision part is configured to calculate the heat transfer coefficient $h_R$ between the reference surface 10 and the acid solution 3 from the measurement results of the temperatures (Tm1, Tm2, etc.) obtained by the measurement part 8 (thermocouple 9A, 9B, etc.).

The heat transfer coefficient $h_R$ between the reference surface 10 and the acid solution 3 can be obtained as follows, for instance.

As depicted in FIG. 3, in a case where the internal temperature (Tm1) is measured at a single site in the first direction (the point P1 in the example shown in FIG. 3), a heat equation of a system including the heat conductor 30 in the first direction is to be solved, thereby obtaining the temperature Ts of the heat conductor 30 at the reference surface 10 such that the output (heat quantity) Q of the heat source and the temperature Tm1 at the point P1 have a matching relationship.

Alternatively, as depicted in FIGS. 4 and 5, in a case where the internal temperatures (Tm1 and Tm2) are measured at two or more sites in the first direction (the point P1 and the point P2 in the examples shown in FIG. 4 and FIG. 5), a heat equation of a system including the heat conductor 30 in the first direction is to be solved, thereby obtaining the surface temperature (temperature at the reference surface 10) Ts of the heat conductor 30 such that the temperature Tm1 at the point P1 and the temperature Tm2 at the point P2 have a matching relationship.

Furthermore, from the inverse heat conduction analysis disclosed in JP2015-78858, for instance, the heat flux 'q' at the reference surface 10 (exposed surface 31) of the heat conductor 30 can be obtained from the internal temperature Tm1 or Tm2 of the heat conductor 30 at the point P1 or the point P2.

Furthermore, by substituting the surface temperature Ts and the heat flux 'q' obtained as described above, and the bulk temperature Tf of the acid solution 3 into the following equation, it is possible to calculate the heat transfer coefficient $h_R$ between the reference surface 10 and the acid solution 3.

$$h_R = q/(Ts - Tf)$$

Furthermore, the pickling facility 1 may further include a temperature sensor (not depicted) for measuring the bulk temperature Tf of the acid solution 3.

As described above, in the illustrative embodiments depicted in FIGS. 3 to 5, the heat source 32 is disposed to be in contact with the heat conductor 30 at the opposite side of the reference surface 10 of the heat conductor 30, and thus a temperature difference is created between the acid solution 3 and the reference surface 10 (exposed surface 31) of the heat conductor 30, and thereby it is possible to calculate the heat conductor $h_R$ between the acid solution 3 and the above described reference surface 10. Furthermore, the measurement part 8 is configured to measure the temperature inside the heat conductor 30, and thereby it is possible to calculate the above described heat transfer coefficient $h_R$ on the basis of the temperature measurement result.

Further, it is possible to appropriately set the conveyance speed (line speed) V of the steel plate 2 on the basis of the accordingly obtained heat transfer coefficient $h_R$, and thereby it is possible to improve the production efficiency of the steel plate 2.

Furthermore, in the illustrative embodiment depicted in FIGS. 4 and 5, the temperatures Tm1, Tm2 of the at least two points P1, P2 disposed at different distances from the reference surface 10 inside the heat conductor 30 are measured, and thus it is possible to obtain the heat flux inside the heat conductor 30 accurately. Thus, from the accordingly obtained heat flux, it is possible to calculate the heat transfer coefficient $h_R$ between the acid solution 3 and the above described reference surface 10 accurately.

In some embodiments, as depicted in FIG. 5 for instance, at the temperature measurement position (P1 or P2) by the measurement part 8 in the first direction connecting the reference surface 10 (exposed surface 31) of the heat conductor 30 and the heat source 32, the cross-sectional area A1 of the heat conductor 30 taken orthogonal to the first direction is smaller than the area A2 of the reference surface 10 (exposed surface 31) of the heat conductor 30.

As described above, at the temperature measurement position (P1 or P2) in the first direction connecting the reference surface 10 of the heat conductor 30 and the heat source 32, with the cross-sectional area A1 of the heat conductor 30 taken in a direction orthogonal to the first direction being smaller than the area A2 of the reference surface 10 of the heat conductor 30, it is possible to have a higher heat flux at the temperature measurement position (P1 or P2) of the heat conductor 30. Accordingly, it is possible to increase the temperature difference between the acid solution 3 and the temperature of the heat conductor 30 measured by the measurement part 8, and thereby it is possible to calculate the heat transfer coefficient $h_R$ between the acid solution 3 and the reference surface 10 even more accurately.

Furthermore, in the illustrative embodiment depicted in FIG. 5, at the small-diameter portion 30*a* in the range between the temperature measurement points P1 and P2 in the first direction, the cross-sectional area is constantly A1 (however, A1 is smaller than the area A2 of the reference surface 10 of the heat conductor 30). As described above, with the cross-sectional area between the plurality of temperature measurement points (P1, P2) being relatively small in the first direction, it is possible to increase the heat flux between the temperature measurement points, and have a relatively large temperature measurement gradient.

Of the heat conductor 30, the thickness t1, in the first direction, of the first large-diameter portion 30*b* positioned closer to the heat source 32 from the above described small-diameter portion 30*a*, and the thickness t2, in the first direction, of the second large-diameter portion 30*c* positioned closer to the exposed surface 31 from the above described small-diameter portion 30*a* (see FIG. 5) are set to values such that the surface temperature becomes uniform. For the above thicknesses t1 and t2, appropriate values may be obtained through heat conduction analysis using the area ratio and thermophysical property (density, specific heat, heat conduction coefficient) of the metal part.

Figure 6:
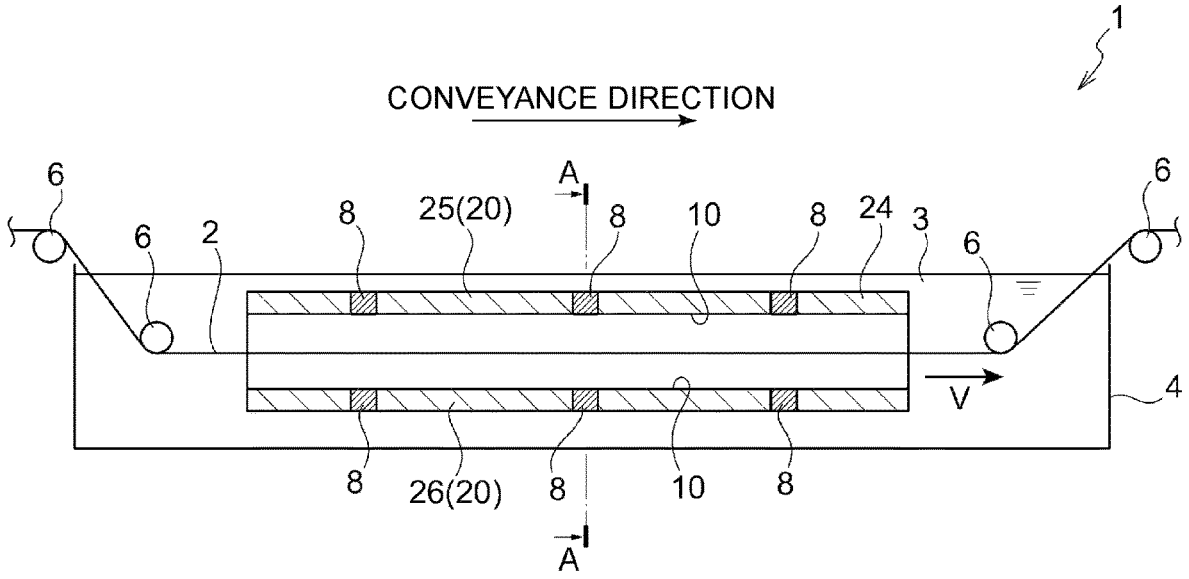
FIG. 6 is a schematic configuration diagram of a pickling facility according to an embodiment.
Figure 7:
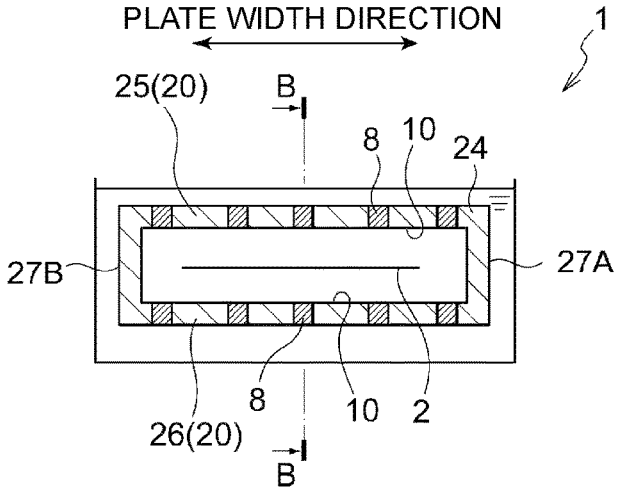
FIG. 7 is an A-A cross-sectional view of the pickling facility depicted in FIG. 6.
Figure 8:
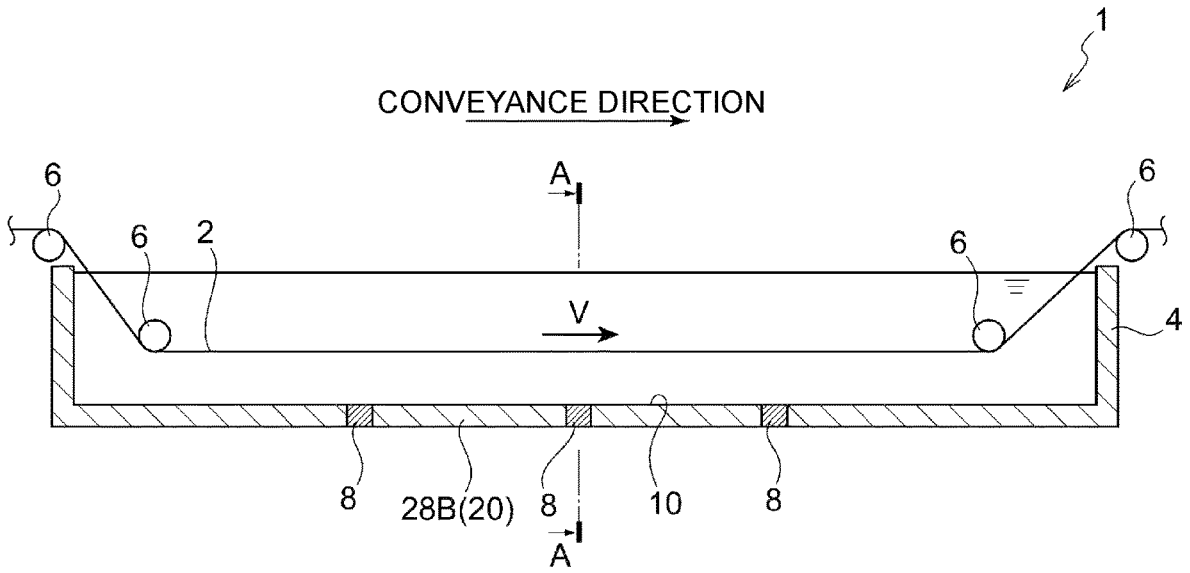
FIG. 8 is a schematic configuration diagram of a pickling facility according to an embodiment.
Figure 9:
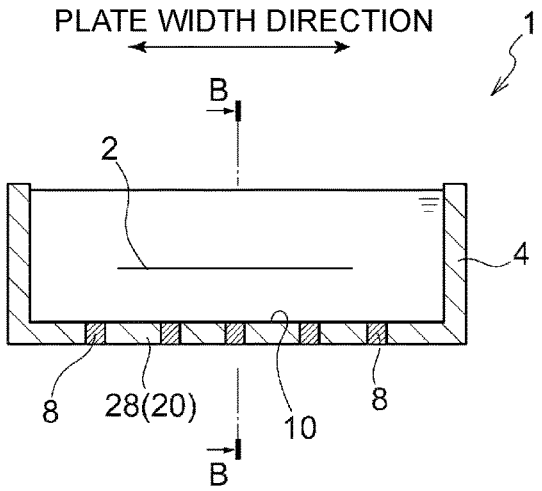
FIG. 9 is an A-A cross-sectional view of the pickling facility depicted in FIG. 8.

FIGS. 6 and 8 are each a schematic diagram of a pickling facility according to an embodiment. FIGS. 7 and 9 are each an A-A cross-sectional view of the pickling facility depicted in FIG. 8. FIGS. 6 and 8 are B-B cross-sectional views of FIGS. 7 and 9, respectively.

The structural body 20 forming a part of the reference surface 10 is not limited to the plate-shaped members 22A, 22B depicted in FIGS. 1 and 2. The structural body 20 may have various shapes.

For instance, in the illustrative embodiment depicted in FIGS. 6 and 7, the pickling facility 1 has a box member 24 including an upper plate portion 25 and a lower plate portion 26 disposed so as to cover the two surfaces of the steel plate 2, and side plate portions 27A and 27B disposed so as to connect the upper plate portion 25 and the lower plate portion 26 at the opposite sides of the steel plate 2. Further, the structural body 20 forming a part of the reference surface 10 includes the upper plate portion 25 and the lower plate portion 26.

As described above, by providing the box portion including the upper plate portion 25 and the lower plate portion 26 that cover the two surfaces of the steel plate 2, it is possible to suppress the thickness of the layer boundary that develops on the surface of the steel plate 2 at the time when the steel plate 2 passes through the acid solution 3 up to the inner surface of the box member 24. Accordingly, it is possible to promote mass transfer to the surface of the steel plate 2, and calculate the heat transfer coefficient $h_R$ between the reference surface 10 and the acid solution 3 while promoting the pickling reaction at the surface of the steel plate 2.

Furthermore, for instance, in the illustrative embodiment depicted in FIGS. 8 and 9, the structural body 20 forming a part of the reference surface 10 includes a bottom portion 28 of the pickling tank 4.

As described above, by utilizing the bottom portion 28 of the pickling tank 4 as the structural body 20 that forms a part of the reference surface 10, it is possible to calculate the heat transfer coefficient $h_R$ between the reference surface 10 and the acid solution 3 while making the pickling facility 1 more compact.

Hereinafter, the pickling facility and the operation method of the pickling facility according to some embodiments will be described briefly.

(1) According to at least one embodiment of the present invention, a pickling facility includes: a pickling tank for storing an acid solution; a conveyance part for continuously conveying a steel plate immersed in the acid solution; a measurement part for measuring at least one parameter which has a correlation with a heat transfer coefficient between the acid solution and a reference surface disposed in the acid solution so as to face the steel plate; and a conveyance speed decision part configured to decide a conveyance speed of the steel plate conveyed by the conveyance part, on the basis of a measurement result of the at least one parameter.

According to the findings of the present inventors, the heat transfer coefficient $h_R$ between the acid solution and the reference surface disposed so as to face the steel plate being conveyed in the acid solution has a correlation with the heat transfer coefficient between the steel plate and the acid solution. Thus, the heat transfer coefficient between the above described reference surface and the acid solution serves as an index of the pickling speed of the steel plate.

In this regard, with the above configuration (1), at least one parameter having a correlation with the heat transfer coefficient between the acid solution and the reference surface disposed so as to face the steel plate in the acid solution is measured. Thus, it is possible to determine the pickling speed of the steel plate or the progress state of the pickling process from the at least one parameter. Thus, it is possible to appropriately set the conveyance speed (line speed) of the steel plate taking into account the at least one parameter, and thereby it is possible to improve the production efficiency of the steel plate.

(2) In some embodiments, in the above configuration (1), the conveyance speed decision part is configured to: calculate the heat transfer coefficient from the measurement result of the at least one parameter obtained by the measurement part; and decide the conveyance speed of the steel plate on the basis of the calculation result of the heat transfer coefficient.

With the above configuration (2), the heat transfer coefficient between the acid solution and the reference surface disposed so as to face the steel plate in the acid solution is calculated from the parameter measured by the measurement part, and thereby it is possible to appropriately set the conveyance speed (line speed) of the steel plate on the basis of the heat transfer coefficient, and thereby it is possible to improve the production efficiency of the steel plate.

(3) In some embodiments, in the above configuration (1) or (2), the pickling facility includes: a heat conductor forming at least a part of the reference surface; and a heat source disposed in contact with the heat conductor at an opposite side of the reference surface of the heat conductor. The measurement part is configured to measure a temperature inside the heat conductor as one of the at least one parameter.

With the above configuration (3), the heat source is disposed so as to be in contact with the heat conductor at the opposite side of the reference surface of the heat conductor, and thus a temperature difference is created between the acid solution and the heat conductor, and thereby it is possible to calculate the heat transfer coefficient between the acid solution and the above described reference surface. Furthermore, the temperature inside the heat conductor is measured, and thereby it is possible to calculate the above described heat transfer coefficient on the basis of the temperature measurement result. Therefore, it is possible to appropriately set the conveyance speed (line speed) of the steel plate on the basis of the accordingly obtained heat transfer coefficient, and thereby it is possible to improve the production efficiency of the steel plate.

(4) In some embodiments, in the above configuration (3), the pickling facility further includes a heat insulator surrounding the heat conductor and the heat source.

With the above configuration (4), the heat insulator is disposed so as to surround the heat conductor and the heat source, and thus it is possible to suppress heat transfer between the heat conductor and surrounding members, and thereby it is possible to calculate the heat transfer coefficient between the acid solution and the above described reference surface more accurately.

(5) In some embodiments, in the above configuration (3) or (4), the pickling facility further includes a structural body having a surface which faces the steel plate in the acid solution. The surface of the structural body forms a part of the reference surface, and the heat conductor is supported by the structural body such that the reference surface of the heat conductor faces the steel plate and is exposed to the acid solution.

With the above configuration (5), the heat conductor is supported by the structural body forming the above described reference surface with the heat conductor, and thus it is possible to calculate the heat transfer coefficient between the acid solution and the above described reference surface with a more compact configuration than that in a case where the heat conductor is supported by another member.

(6) In some embodiments, in the above configuration (5), the reference surface of the heat conductor faces the steel plate, and the reference surface of the heat conductor is flush with the reference surface of the structural body.

With the above configuration (6), the reference surface of the heat conductor is flush with the reference surface of the structural body, and thus the flow turbulence of the acid solution at the reference surface is suppressed, which makes it possible to calculate the heat transfer coefficient between the acid solution and the above described reference surface more accurately.

(7) In some embodiments, in the above configuration (5) or (6), the structural body includes a plate-shaped member disposed so as to face at least one of two surfaces of the steel plate.

With the above configuration (7), a plate-shaped member is used as the structural body that forms a part of the reference surface and supports the heat conductor, which makes it possible to calculate the heat transfer coefficient between the acid solution and the above described reference surface with a simplified configuration.

(8) In some embodiments, in any one of the above configurations (5) to (7), the structural body includes a bottom portion of the pickling tank.

With the above configuration (8), the bottom portion of the pickling tank is used as the structural body that forms a part of the reference surface and supports the heat conductor, which makes it possible to calculate the heat transfer coefficient between the acid solution and the above described reference surface with a more compact pickling facility.

(9) In some embodiments, in any one of the above configurations (5) to (8), the pickling facility includes a box member including an upper plate portion and a lower plate portion disposed so as to cover two surfaces of the steel plate, and a side plate portion disposed so as to connect the upper plate portion and the lower plate portion at at least one of opposite sides of the steel plate. The structural body includes at least one of the upper plate portion or the lower plate portion.

With the above configuration (9), the box member including the upper plate portion and the lower plate portion that cover the two surfaces of the steel plate is provided, and thereby it is possible to suppress the thickness of the layer boundary that develops on the surface of the steel plate at the time when the steel plate passes through the acid solution up to the inner surface of the box member. Accordingly, it is possible to promote mass transfer to the surface of the steel plate, and calculate the heat transfer coefficient between the reference surface and the acid solution while promoting the pickling reaction at the surface of the steel plate.

(10) In some embodiments, in any one of the above configurations (3) to (9), the measurement part is configured to measure, as one of the at least one parameter, each of temperatures of at least two sites positioned at different distances from the reference surface inside the heat conductor, and the conveyance speed decision part is configured to: calculate the heat transfer coefficient from a measurement result of the at least one parameter of each of the sites obtained by the measurement part; and decide the conveyance speed of the steel plate on the basis of a calculation result of the heat transfer coefficient.

With the above configuration (10), the temperatures of the at least two sites disposed at different distances from the reference surface inside the heat conductor are measured, and thus it is possible to obtain the heat flux inside the heat conductor accurately. Thus, from the accordingly obtained heat flux, it is possible to calculate the heat transfer coefficient between the acid solution and the above described reference surface accurately.

(11) In some embodiments, in any one of the above configurations (3) to (10), a cross-sectional area of the heat conductor taken orthogonal to a direction connecting the heat source and the reference surface of the heat conductor at a temperature measurement position by the measurement part in the direction is smaller than an area of the reference surface of the heat conductor.

With the above configuration (11), at the temperature measurement position in the direction connecting the reference surface of the heat conductor and the heat source, with the cross-sectional area of the heat conductor taken orthogonal to the direction being smaller than the area of the reference surface of the heat conductor, it is possible to have a higher heat flux at the temperature measurement position of the heat conductor. Accordingly, it is possible to increase the temperature difference between the acid solution and the temperature of the heat conductor measured by the measurement part, and thereby it is possible to calculate the heat transfer coefficient between the acid solution and the reference surface even more accurately.

(12) In some embodiments, in any one of the above configurations (1) to (11), the measurement part is configured to measure the at least one parameter at each of at least two positions which are different from one another in a plate width direction of the steel plate, and the conveyance speed decision part is configured to decide the conveyance speed of the steel plate conveyed by the conveyance part, on the basis of a measurement result of the at least one parameter obtained at each of the at least two positions.

With the above configuration (12), by measuring at least one parameter having a correlation with the heat transfer coefficient between the acid solution and the reference surface at each of a plurality of positions in the plate width direction of the steel plate, it is possible to determine the pickling speed of the steel plate or the progress state of the pickling process more specifically. Thus, it is possible to appropriately set the conveyance speed (line speed) of the steel plate taking into account the at least one parameter, and thereby it is possible to improve the production efficiency of the steel plate.

(13) In some embodiments, in any one of the above configurations (1) to (12), the measurement part is configured to measure the at least one parameter at each of at least two positions which are different from one another in a conveyance direction of the steel plate, and the conveyance speed decision part is configured to decide the conveyance speed of the steel plate conveyed by the conveyance part, on the basis of a measurement result of the at least one parameter obtained at each of the at least two positions.

With the above configuration (13), by measuring at least one parameter having a correlation with the heat transfer coefficient between the acid solution and the reference surface at each of a plurality of positions in the conveyance direction of the steel plate, it is possible to determine the pickling speed of the steel plate or the progress state of the pickling process more specifically. Thus, it is possible to appropriately set the conveyance speed (line speed) of the steel plate taking into account the parameter, and thereby it is possible to improve the production efficiency of the steel plate.

(14) According to at least one embodiment of the present invention, a method of operating a pickling facility is a method of operating a pickling facility which includes: a pickling tank for storing an acid solution; and a conveyance part for continuously conveying a steel plate immersed in the acid solution. The method includes: a step of measuring at least one parameter which has a correlation with a heat transfer coefficient between the acid solution and a reference surface disposed in the acid solution so as to face the steel plate; and a step of deciding a conveyance speed of the steel plate conveyed by the conveyance part, on the basis of a measurement result of the at least one parameter.

According to the above method (14), at least one parameter having a correlation with the heat transfer coefficient between the acid solution and the reference surface disposed so as to face the steel plate in the acid solution is measured. Thus, it is possible to determine the pickling speed of the steel plate or the progress state of the pickling process from the parameter. Thus, it is possible to appropriately set the conveyance speed (line speed) of the steel plate taking into account the parameter, and thereby it is possible to improve the production efficiency of the steel plate.

Embodiments of the present invention were described in detail above, but the present invention is not limited thereto, and various amendments and modifications may be implemented.

Further, in the present specification, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

REFERENCE SIGNS LIST

1 Pickling facility
2 Steel plate
3 Acid solution
4 Pickling tank
6 Conveyance roll
8 Measurement part
9A Thermocouple
9B Thermocouple
10 Reference surface
20 Structural body
21 Surface
22A Plate-shaped member
22B Plate-shaped member
24 Box member
25 Upper plate portion
26 Lower plate portion
27A Side plate portion
27B Side plate portion
28 Bottom portion
30 Heat conductor
30*a* Small-diameter portion
30*b* First large-diameter portion
30*c* Second large-diameter portion
31 Exposed surface
32 Heat source
34 Heat insulator
100 Control device

The invention claimed is:

1. A pickling facility, comprising:
a pickling tank for storing an acid solution;
a conveyor continuously conveying a steel plate immersed in the acid solution;
a temperature detector measuring at least one parameter which has a correlation with a heat transfer coefficient between the acid solution and a reference surface disposed in the acid solution so as to face the steel plate;
a controller configured to decide a conveyance speed of the steel plate conveyed by the conveyor on a basis of a measurement result of the at least one parameter;
a heat conductor forming at least a first part of the reference surface; and
a heat source disposed in contact with the heat conductor at an opposite side of the heat conductor relative to the reference surface,
wherein the temperature detector includes at least one temperature sensor configured to measure a temperature inside the heat conductor as one of the at least one parameter.

2. The pickling facility according to claim 1,
wherein the controller is configured to:
calculate the heat transfer coefficient from the measurement result of the at least on parameter; and
decide the conveyance speed of the steel plate on the basis of the calculated heat transfer coefficient.

3. The pickling facility according to claim 1, further comprising:
a heat insulator surrounding the heat conductor and the heat source.

4. The pickling facility according to claim 1, further comprising:
a structural body having a surface which faces the steel plate in the acid solution,
wherein the surface of the structural body forms a second part of the reference surface, and
wherein the heat conductor is supported by the structural body such that the first part of the reference surface formed by the heat conductor faces the steel plate and is exposed to the acid solution.

5. The pickling facility according to claim 4,
wherein the first part of the reference surface formed by the heat conductor faces the steel plate, and wherein the first part of the reference surface formed by the heat conductor is flush with the second part of the reference surface formed by the structural body.

6. The pickling facility according to claim 4,
wherein the structural body includes a plate-shaped member disposed so as to face at least one of two surfaces of the steel plate.

7. The pickling facility according to claim 4,
wherein the structural body includes a bottom portion of the pickling tank.

8. The pickling facility according to claim 4, further comprising
a member including an upper plate portion and a lower plate portion disposed so as to cover two surfaces of the steel plate, and a side plate portion disposed so as to connect the upper plate portion and the lower plate portion at at least one of opposite sides of the steel plate,
wherein the structural body includes at least one of the upper plate portion or the lower plate portion.

9. The pickling facility according to claim 1,
wherein the temperature detector is configured to measure each of temperatures of at least two sites positioned at different distances from the reference surface inside the heat conductor, and
wherein the controller is configured to:
calculate the heat transfer coefficient from a measurement result of said temperatures measured at each of the at least two sites by the temperature detector; and
decide the conveyance speed of the steel plate on a basis of a calculation result of the heat transfer coefficient.

10. The pickling facility according to claim 1,
wherein a cross-sectional area of the heat conductor taken orthogonal to a direction connecting the heat source and the part of the reference surface formed by the heat conductor at a temperature measurement position of the temperature detector is smaller than an area of the part of the reference surface formed by the heat conductor.

11. The pickling facility according to claim 1,
wherein the temperature detector is configured to measure the at least one parameter at each of at least two positions which are different from one another in a plate width direction of the steel plate, and
wherein the controller is configured to decide the conveyance speed of the steel plate conveyed by the conveyor on a basis of a measurement result of the at least one parameter obtained at each of the at least two positions.

12. The pickling facility according to claim 1, wherein the temperature detector is configured to measure the at least one parameter at each of at least two positions which are different from one another in a conveyance direction of the steep plate, and wherein the controller is configured to decide the conveyance speed of the steel plate conveyed by the conveyor on a basis of a measurement result of the at least one parameter obtained at each of the at least two positions.

13. A method of operating the pickling facility according to claim 1, the method comprising:

a step of measuring, by using the temperature detector, the at least one parameter which has a correlation with a heat transfer coefficient between the acid solution and the reference surface disposed in the acid solution so as to face the steel plate; and a step of the controller deciding a conveyance speed of the steel plate conveyed by the conveyor on a basis of a measurement result of the at least one parameter.

* * * * *